US010913173B2

(12) United States Patent
Betti

(10) Patent No.: US 10,913,173 B2
(45) Date of Patent: Feb. 9, 2021

(54) ROLLER-TYPE COMPRESSION-INCISION-CUTTING UNIT

(75) Inventor: Claudio Betti, Imola (IT)

(73) Assignee: I.M.A. INDUSTRIA MACCHINE AUTOMATICHE S.P.A., Ozzano Dell'Emilia (IT)

( * ) Notice: Subject to any disclaimer, the term of this patent is extended or adjusted under 35 U.S.C. 154(b) by 0 days.

(21) Appl. No.: 13/321,124

(22) PCT Filed: May 14, 2010

(86) PCT No.: PCT/IB2010/052148

§ 371 (c)(1),
(2), (4) Date: Nov. 17, 2011

(87) PCT Pub. No.: WO2010/136929

PCT Pub. Date: Dec. 2, 2010

(65) Prior Publication Data

US 2012/0055305 A1 Mar. 8, 2012

(30) Foreign Application Priority Data

May 25, 2009 (IT) ..... BO2009A000335

(51) Int. Cl.
*B26F 1/38* (2006.01)
*B26D 7/26* (2006.01)
(Continued)

(52) U.S. Cl.
CPC ..... *B26F 1/384* (2013.01); *B26D 1/626* (2013.01); *B26D 7/265* (2013.01); *B26D 7/2628* (2013.01);
(Continued)

(58) Field of Classification Search
CPC ..... B26D 7/2628; B26D 7/265; B26D 1/626; B26F 1/384; B26F 1/44; B65B 29/025; B65B 61/08; Y10T 83/664
(Continued)

(56) References Cited

U.S. PATENT DOCUMENTS 4,130,042 A * 12/1978 Reed ..... B26D 7/2628 100/168
4,226,150 A * 10/1980 Reed ..... 83/346
(Continued)

FOREIGN PATENT DOCUMENTS

DE 44 41 278 A1 3/1996
DE 297 08 683 U1 8/1997
(Continued)

*Primary Examiner* — Jonathan G Riley
(74) *Attorney, Agent, or Firm* — Shuttleworth & Ingersoll, PLC; Timothy J. Klima

(57) ABSTRACT

A roller-type compression—incision—cutting unit for packaging material webs comprises: a motor-driven roller (2) provided with at least one projecting incision—cutting profile (3); a driven counter-roller (4) provided with at least one abutting counter-profile (5); kinematic means (6) for directly transmitting motion, in a synchronised fashion, between the roller (2) and the counter-roller (4), the kinematic means being connected to respective shafts (2*a*, 4*a*); adjustable pusher elements (7), adapted to allow an incision or cutting contact between the roller (2) and the counter-roller (4); at least one rolling element (10, 11) interposed between the roller (2) and the counter-roller (4), and adapted to separate the rotation of the motor-driven roller (2) from the rotation of the thrust rings of the driven counter-roller (4).

14 Claims, 1 Drawing Sheet

(51) Int. Cl.
*B26D 1/62* (2006.01)
*B65B 29/02* (2006.01)
*B65B 61/08* (2006.01)

(52) U.S. Cl.
CPC ..... *B65B 29/025* (2017.08); *B65B 61/08* (2013.01); *Y10T 83/664* (2015.04)

(58) Field of Classification Search
USPC ..... 83/344
See application file for complete search history.

(56) References Cited

U.S. PATENT DOCUMENTS 4,359,919 A * 11/1982 Fuchs ..... B26D 7/2614 83/344
4,732,082 A * 3/1988 Ireton ..... B21D 17/04 101/23
4,756,219 A * 7/1988 Pohl et al. ..... 83/344
5,083,488 A * 1/1992 Stanley et al. ..... 83/698.51
5,233,813 A * 8/1993 Kenney et al. ..... 53/450
5,459,980 A 10/1995 Kenney et al.
5,531,137 A * 7/1996 Guilford ..... 74/569
5,598,758 A * 2/1997 Chmelar ..... B23D 35/008 83/100
6,085,626 A * 7/2000 Pfaff, Jr. ..... 83/698.51
6,244,148 B1 * 6/2001 Vees ..... B26D 7/2628 83/344
6,684,747 B2 * 2/2004 Aichele ..... 83/344
2002/0020270 A1 2/2002 Aichele
2005/0120857 A1 * 6/2005 Pfaff, Jr. ..... B26D 7/2628 83/698.51
2006/0048616 A1 * 3/2006 Grenier et al. ..... 83/13
2007/0039443 A1 2/2007 Takahashi et al.
2008/0282860 A1 * 11/2008 Pfaff, Jr. ..... B26D 7/1818 83/128
2009/0013830 A1 * 1/2009 Pfaff, Jr. ..... B23P 15/406 76/107.8

FOREIGN PATENT DOCUMENTS

EP 0 899 068 A2 3/1999
GB 2 314 312 A 12/1997
IT 1 242 618 B 5/1994
JP H06-506398 A 7/1994
JP H08-052696 A 2/1996
JP H11188697 7/1999
JP 2001-105395 A 4/2001
JP 2007229832 9/2007
JP 2008-200805 A 9/2008
WO 92/18295 A1 10/1992
WO 2005021224 A1 3/2005

* cited by examiner

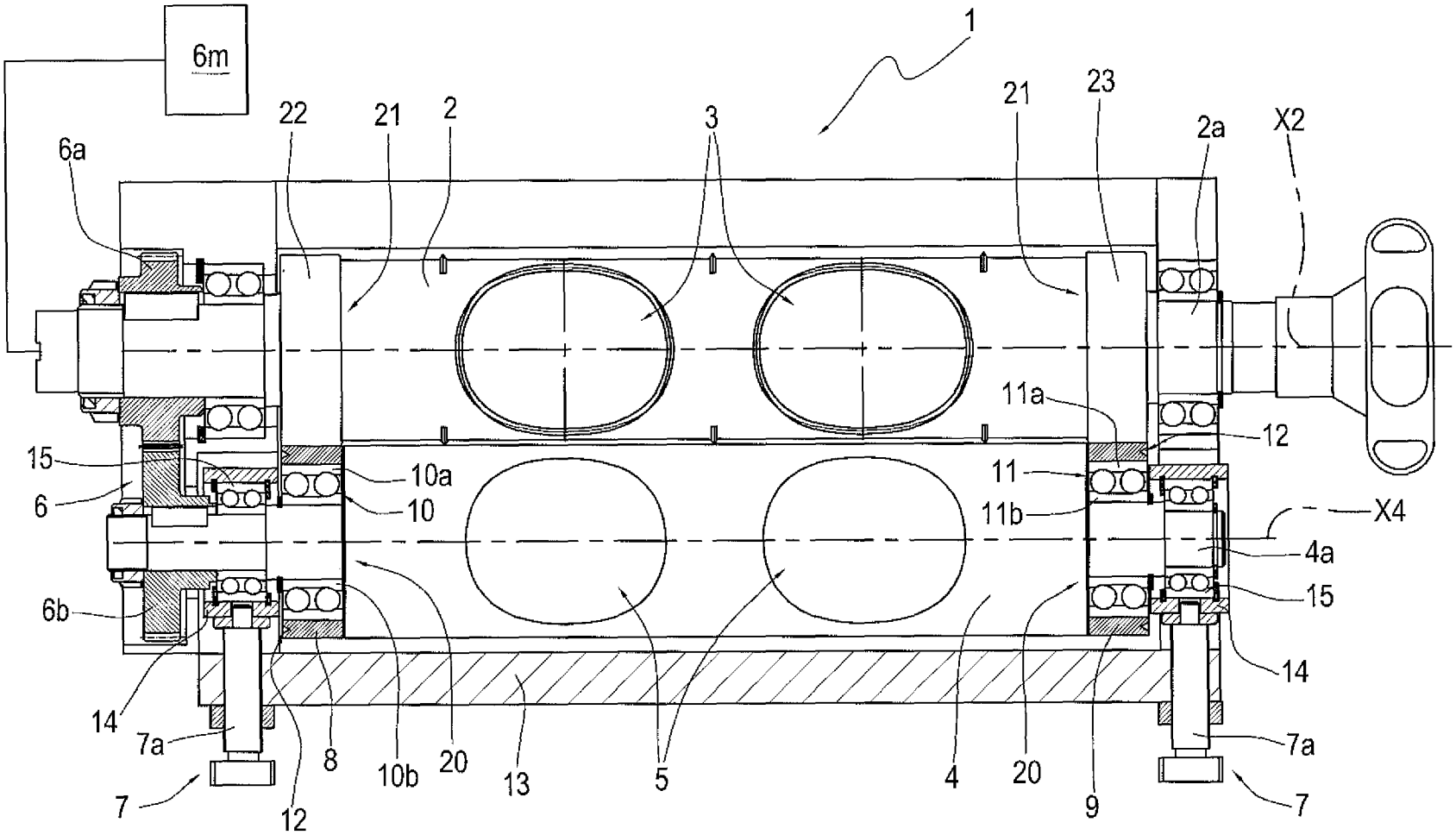
X2
X4
2a
12
4a
15
14
7a
7
23
9
21
11a
11
11b
20
1
4
3
5
13
2
10a
10
20
21
10b
8
22
12
6m
7a
7
14
6a
15
6
6b

ROLLER-TYPE COMPRESSION-INCISION-CUTTING UNIT

TECHNICAL FIELD

This invention relates to a roller-type compression—incision—cutting unit, in particular which can be used on machines for making pods containing infusion products.

BACKGROUND ART

In the above-mentioned machines a roller-type compression—incision—cutting unit is often used, that is to say, a station comprising roller-type pressers or knives adapted, respectively, to compress, or incise or cut packaging material.

For example, said units allow continuous filter paper webs, which have successive closed pods containing the dose of product, to be cut as they pass between two rotating rollers. The latter have respective profiles substantially copying the desired shape of the pod.

These units comprise:

- a motor-driven roller provided with one (or more) projecting profiles with respective blades forming the actual cutter—knife;
- a driven counter-roller, provided with one (or more) abutting counter-profiles and whose axis is parallel with the roller;
- kinematic means for directly transmitting motion between the motor-driven roller and the counter-roller, typically gear wheels;
- adjustable pusher elements, acting on the counter-roller for allowing calibrated contact between the roller and the counter-roller in such a way as to apply an operating pressure on the filter paper web.

Basically, the roller and the counter-roller, whose axes of rotation are parallel, are made to rotate in a synchronised fashion by a direct gear transmission system in such a way that they rotate in opposite directions.

The counter-roller is brought into contact (with a thrust value that can be precisely adjusted) with the roller to apply the operating pressure.

The thrust adjustment is essential and must be extremely precise to avoid premature wear of the profile blades. That problem occurs because, without a precise zone for discharging the forces, concentrated forces would be generated, due to the thrust of the counter-roller on the roller—counter-roller contact surfaces, which vary in size and which are distributed along the contact generatrix between the roller and the counter-roller, in particular on the incision—cutting profiles.

To avoid an excessive load on the blades, at the ends of the roller and the counter-roller thrust elements and supporting elements are respectively made (for example thrust rings and supporting rings), integral with the respective roller and counter-roller and adapted to form precise contact points on which most of the thrust of the counter roller onto the roller can be discharged, consequently lightening the load on the operating contact zones, which in this way operate in an optimum fashion.

The operating pressure is usually obtained by making the projecting profiles in such a way that, when the thrust rings and the supporting rings are brought into contact with each other, the profiles elastically deform on contact with the counter-roller, generating the operating pressure.

However this cutting unit has a disadvantage due precisely to the presence and structure of these two rings positioned on the roller and the counter-roller.

It was noticed that with this configuration there is a double transmission of motion between the roller and the counter-roller: one by the kinematic means described above and one by the thrust rings and the supporting rings which act like friction wheels. Since the latter, due to processing errors (tolerances on diameters, eccentricity, etc.) cannot be exactly the same as the corresponding diameters of the pitch circles of the gears belonging to the kinematic means, dragging occurs at the line of contact between the thrust rings and the supporting rings.

This difference in the surface speed of the two rollers creates, as a direct consequence, stresses and friction which are unwanted and harmful to the gear transmission system, with possible increased wear or damage to the gear teeth.

In addition, it should be noticed that this problem may also arise on new units which have just been assembled, due to possible small differences between the diameters of the rollers and the thrust rings caused by processing imprecisions/tolerances.

DISCLOSURE OF THE INVENTION

The aim of this invention is therefore to overcome these disadvantages by providing a roller-type incision—cutting unit structured in such a way that it allows correct thrust between the roller and the counter-roller, substantially maintaining unchanged the construction architecture of the rollers, and precise, reliable transmission of motion in a synchronised fashion between said rollers.

Accordingly, the invention achieves that aim with a roller-type compression—incision—cutting unit comprising the technical features described in one or more of the appended claims.

A roller-type compression—incision—cutting unit made in accordance with the invention is advantageously applied in the cutting of packaging material, for example filter paper webs containing infusion products.

BRIEF DESCRIPTION OF THE DRAWINGS

The technical features of the invention, with reference to the above aims, are clearly described in the claims below and its advantages are apparent from the detailed description which follows, with reference to the accompanying drawing which illustrates a preferred, non-limiting embodiment, showing a front view with some parts in cross-section to better illustrated others, of the roller-type incision—cutting unit in accordance with this invention.

DETAILED DESCRIPTION OF THE PREFERRED EMBODIMENTS OF THE INVENTION

With reference to the accompanying drawing, the roller-type unit according to this invention, labelled 1 as a whole, is used for the incision or cutting of continuous filter paper webs.

On these webs (not illustrated in the accompanying drawing) a series of closed pods is formed, each containing a dose of infusion product.

As the accompanying drawing shows, the roller-type incision—cutting unit 1 basically comprises:

- a motor-driven roller 2 defining a first axis X2 and provided with one or more (for example two are visible in the accompanying drawing) compression—incision—cutting profiles 3 (in this case having an elliptical shape) arranged side by side and having respective blades projecting from them;

a driven counter-roller 4, mounted on a second shaft 4*a* and provided with one or more (for example two are visible in the accompanying drawing) respective abutting counter-profiles 5, the counter-roller 4 defining an axis X4 which is parallel with the axis X2 of the motor-driven roller 2;

kinematic means 6 for directly transmitting motion, in a synchronised fashion, between the motor-driven roller 2 and the counter-roller 4, the kinematic means being connected to a first shaft 2*a* supporting the roller 2 and to a second shaft 4*a* supporting the counter-roller 4;

thrust or bearing elements 20 connected to the ends of the counter-roller 4 and adapted to make contact with supporting elements 21 connected to the ends of the roller 2;

pusher elements 7, advantageously adjustable, adapted for pushing the thrust or bearing elements 20 into contact with the supporting elements 21; and at least one element, advantageously of rolling type, interposed between the roller 2 and the counter-roller 4; in the embodiment shown in FIG. 1, there being two rolling elements 10, 11, which are substantially identical.

The motor-driven roller 2 is made to rotate about the first axis X2 by a drive unit 6*m*, schematically illustrated with a block. The first shaft 2*a* is fitted with a driving gear wheel 6*a*, which meshes with a driven gear wheel 6*b* fitted on the shaft 4*a* of the counter-roller 4.

The pusher elements 7 are mounted at the ends of the second shaft 4*a*, at the ends of the counter-roller 4, and comprise a pair of screws 7*a* connected in such a way that they can be tightened and slackened to a supporting frame 13, and pushing shoes 14 for supporting the roller 4 against the roller 2.

Inside the shoe 14 there is a bearing 15, allowing rotation of the counter-roller 4.

Therefore, by tightening or slackening the screws 7*a* a radial thrust is created on the counter-roller 4 towards the roller 2, making use of the play between the toothing of the driving gear wheel 6*a* and the driven gear wheel 6*b*.

Advantageously, in the embodiment in FIG. 1, the thrust or bearing elements 20 comprise thrust or bearing rings 8, 9 positioned at the respective ends of the counter-roller 4 and mounted on the respective rolling elements 10, 11, therefore being in tangential contact with the supporting elements 21, which also in the embodiment in FIG. 1, are illustrated as supporting rings 22, 23 made integral with the roller 2.

In an alternative embodiment, not illustrated, the thrust elements 20 may be directly the rolling elements 10, 11 and the thrust rings 8, 9 can be omitted.

If necessary, the thrust rings 8, 9 help to further stiffen the respective rolling elements 10, 11.

In the embodiment with thrust rings illustrated in FIG. 1, each rolling element 10, 11 is interposed between the respective thrust ring 8, 9 and the counter-roller 4. This allows rotation of the respective thrust ring 8, 9, in contact with the supporting rings 22, 23, to be separated from the rotation of the counter-roller 4.

Each of the rolling elements 10, 11 is positioned coaxially on the shaft 4*a* of the second, counter-roller 4.

In terms of positioning, each thrust ring 8, 9 is interposed and in rotary contact between an external part 10*a*, 11*a* of the respective rolling element 10, 11 and the supporting rings 22, 23, in such a way that it can rotate relative to the counter-roller 4 driven by the motor-driven roller 2.

Moreover, an internal part 10*b*, 11 *b* of the rolling element 10, 11 is coupled to the second shaft 4*a*.

The internal part 10*b*, 11 *b* of the rolling element 10, 11 rotates with the shaft 4*a* of the second roller 4.

Advantageously, each rolling element comprises a bearing 10, 11 (in this case a ball bearing, by way of example only) with an external ring in contact with the respective thrust ring 8, 9 and an internal ring mounted on and constrained to the second shaft 4*a*, in such a way as to keep the speed of rotation of the driven counter-roller 4 independent of the speed of rotation of the thrust rings 8, 9, whose rotation is driven by friction by the supporting rings 22, 23 of the motor-driven roller 2.

The rings 8, 9 are advantageously made of metal, giving the rolling elements 10, 11 greater stiffness.

Therefore, thanks to the presence of the bearings interposed between the counter-roller and the thrust rings, a sort of "friction wheel transmission system" is created.

In practice, the system derived from the configuration described provides one driving unit (motor-driven roller 2) and two independent driven units: the counter-roller 4 whose rotation is driven by the kinematic direct transmission means, and the external parts 10*a*, 11*a* of the rolling elements (or the thrust rings if present) whose rotation is driven by the supporting rings 22, 23 of the roller 2 by means of friction.

The system designed in this way allows the motor-driven roller 2 and the counter-roller 4 to be synchronised thanks to the pair of gear wheels, whilst the external parts 10*a*, 11*a* of the rolling elements (or the thrust rings 8, 9 if present) are driven by the roller 2 thanks to their tangential friction contact or point, but their rotation is independent of the rotation of the counter-roller 4. In other words, thanks to the bearings interposed between the roller 2 and the counter-roller 4, at the thrust elements and the supporting elements, the roller 2 does not transmit a rotational torque to the counter-roller 4.

Since they can rotate independently of the rotation of the counter-roller 4, the first external parts 10*a*, 11*a* of the rolling elements (or the thrust rings 8, 9 if present) and the roller 2 rotate with the same respective surface speeds, thanks to respective friction zones.

Therefore, said operating condition prevents potential speed differences between the thrust elements and the supporting elements from affecting the gear transmission system.

Moreover, since the rolling elements (or the thrust rings if present) roll on the roller substantially without dragging, wear associated with the external parts of the rolling elements (or with the thrust rings if present) is in any case extremely limited. In short, the angular rotation transmitted by the roller 2 to the rolling elements, for any speed adopted by the rolling elements, does not affect the rotation of the counter-roller 4, which remains driven only by the gear transmission system connected to the second shaft 4*b*.

The compression—incision—cutting unit just described may be modified in several ways, without thereby departing from the scope of the inventive concept.

For example, the kinematic direct transmission means may comprise elements other than the driving gear wheel and the driven gear wheel illustrated with reference to FIG. 1. For example, the transmission means may be of the belt type, or of the type with an independent drive unit.

As regards the rolling elements connecting the roller and the counter-roller, the ball bearings illustrated may be substituted with wheels, roller and/or needle bearings, whether normal or pre-loaded. The rolling elements may also be substituted with bushings or other sliding elements.

Moreover, in an alternative embodiment, the thrust rings may be omitted, so that the rolling elements make contact directly with the roller. If bearings or wheels which have an external ring and an internal ring are used, the external ring will make contact directly with the roller, whilst the internal ring will be connected to the counter-roller (or to the shaft supporting the counter-roller).

In an alternative embodiment the pusher elements may comprise elastic elements, or pneumatic or hydraulic actuators.

An incision—cutting unit according to the invention may advantageously be used for the compression, incision or cutting of paper, cardboard and plastic materials in general for packaging and wrapping products.

The invention claimed is:

1. A roller-type compression incision cutting unit for packaging material comprising:

a drive roller having a first shaft and defining a first axis and including a projecting compression incision cutting profile; the roller being adapted to rotate about the first axis and comprising first and second supporting elements on opposite ends of the first shaft respectively;

a driven counter-roller having a second shaft and defining a second axis parallel with the first axis, the second shaft having a first end portion adjacent a first end thereof and a second end portion adjacent a second, opposite, end thereof, the counter-roller including an outer surface with an abutting counter-profile configured to cooperate with the projecting compression incision cutting profile, wherein the counter-roller, including the outer surface, is driven in rotation on the second axis when the second shaft is rotated;

a first gear wheel fitted on the first shaft supporting the drive roller;

a second gear wheel fitted on the second shaft supporting the counter-roller, the first gear wheel meshing with the second gear wheel for directly transmitting motion, in a synchronized fashion, between the drive roller and the counter-roller;

first and second thrust assemblies respectively mounted on the first and second end portions of the second shaft and respectively in direct and continuous rolling contact with the first and second supporting elements, the first thrust assembly comprising:

a single first bearing between the first supporting element and the first end portion of the second shaft; and a first rolling thrust ring encircling the first bearing and, concentrically with the outer surface, being in direct and continuous rolling contact with the first supporting element, the first rolling thrust ring being made of metal;

the second thrust assembly comprising:

a single second bearing between the second supporting element and the second end portion of the second shaft; and a second rolling thrust ring encircling the second bearing and, concentrically with the outer surface, being in direct and continuous rolling contact with the second supporting element, the second rolling thrust ring being made of metal;

wherein the first and second bearings have respective first and second internal parts, respective first and second external parts and respective first bearing balls and second bearing balls, the first and second external parts being in contact with the respective first and second rolling thrust rings, the first internal and external parts of the first bearing being in rolling contact with the first bearing balls and the second internal and external parts of the second bearing being in rolling contact with the second bearing balls;

wherein the first and second internal parts are rigidly fixed to the first and second end portions of the second shaft, respectively; and wherein the first and second rolling thrust rings are effective to rotate about the second axis driven in rotation by the first and second supporting elements of the drive roller respectively by friction, in such a way as to keep a speed of rotation of the driven counter-roller independent of a speed of rotation of the first and second rolling thrust rings, to allow the rotation of the counter-roller to be driven only by the directly transmitted motion of the meshing first and second gear wheels.

2. The unit according to claim 1, wherein, at the first and second thrust assemblies and the first and second supporting elements, the drive roller does not transmit a rotational torque to the counter-roller.

3. The unit according to claim 1, wherein each of the first and second rolling thrust rings is made of a circular band of metal having a rectangular cross-section extending axially to form a uniform interior cylindrical surface encircling and engaging the respective external part to stiffen the respective first and second bearings.

4. The unit according to claim 1, wherein the packaging material consists of filter paper webs suitable to contain infusion products.

5. The unit according to claim 1, comprising first and second pusher elements configured to push the respective first and second thrust assemblies into contact with the respective first and second supporting elements, the first and second pusher elements being effective to push against the first and second end portions respectively of the second shaft and correspondingly urge the second shaft towards the first shaft.

6. The unit according to claim 5, wherein the first and second pusher elements are mounted, respectively, adjacent to the first and second end portions of the second shaft.

7. The unit according to claim 5, wherein the second shaft is positioned between the first shaft and the first and second pusher elements.

8. The unit according to claim 5, wherein each of the first and second end portions of the second shaft has an inner end portion and an outer end portion adjacent to each other, each of the first and second pusher elements being arranged to push against the respective outer end portion, each of the first and second bearings being mounted on the respective inner end portion.

9. The unit according to claim 8, wherein each of the first and second pusher elements comprises a screw connected in such a way to be able to push against a respective first and second shoe.

10. The unit according to claim 9, comprising first and second counter-bearings rotationally mounted at the respective outer end portions of the second shaft of the counter-roller, wherein the first pusher element pushes the first shoe against the first counter-bearing, the first shoe contacting an exterior surface of the first counter-bearing, and wherein the second pusher element pushes the second shoe against the second counter-bearing, the second shoe contacting an exterior surface of the second counter-bearing.

11. The unit according to claim 10, wherein each of the first and second shoes has a respective opening, each of the first and second pusher elements has a first end extending from a body, the first end of the first pusher element engaging the first shoe at the respective opening, the first end of the second pusher element engaging the second shoe at the respective opening.

12. The unit according to claim 11, and further comprising a spacer positioned around the first end of each of the first and second pusher elements, the spacer having a spacer width greater than a width of the body of each of the first and second pusher elements whereby the pushing force is distributed along the respective shoe.

13. The unit according to claim 5, wherein the first pusher element is located distal to the first thrust assembly, and the second pusher element is located distal to the second thrust assembly.

14. The unit according to claim 5, wherein the first pusher element is axially offset from the first thrust assembly along the first end portion of the second shaft and the second pusher element is axially offset from the second thrust assembly along the second end portion of the second shaft.

* * * * *